United States Patent [19]

Spaulding

[11] 4,113,338

[45] Sep. 12, 1978

[54] INSULATION-PIERCING CONTACT

[75] Inventor: Tedford Hollace Spaulding, Norridge, Ill.

[73] Assignee: Bunker Ramo Corporation, Oak Brook, Ill.

[21] Appl. No.: 756,497

[22] Filed: Jan. 3, 1977

[51] Int. Cl.[2] ..... H01R 11/20

[52] U.S. Cl. ..... 339/97 R

[58] Field of Search ..... 339/97–99

[56] References Cited

U.S. PATENT DOCUMENTS

| | | | |
|---|---|---|---|
| 3,233,206 | 2/1966 | Fiala | 339/98 |
| 3,874,762 | 4/1975 | Shott et al. | 339/91 R |
| 3,895,852 | 7/1975 | Wasserlein, Jr. | 339/99 R |
| 3,926,498 | 12/1975 | Hoppe, Jr. | 339/97 R |

*Primary Examiner*—Joseph H. McGlynn
*Attorney, Agent, or Firm*—William Lohff; F. M. Arbuckle

[57] ABSTRACT

A contact member is disclosed having a novel insulation-piercing terminal which penetrates and strips insulation from a conductor to provide an optimal mechanical and electrical solderless connection with the conductor. The terminal includes means for radially penetrating the insulation, means for stripping the insulation from a longitudinal portion of the conductor and means for contacting the thus exposed conductor in wiping engagement.

15 Claims, 13 Drawing Figures

INSULATION-PIERCING CONTACT

BACKGROUND OF THE INVENTION

The present invention relates to electrical connecting devices and, particularly, to a novel insulation-piercing contact which may be used in a variety of electrical applications to effect solderless electrical terminal connections.

Insulation-piercing contacts have gained wide acceptance in the communications and data handling industries. Their use has been found particularly advantageous in multi-contact connectors and miniaturized circuit boards where conventional soldering techniques have proven time consuming, difficult and oftentimes deleterious to the associated conductors and electrical components being connected. Examples of typical prior art insulation-piercing contacts are disclosed in U.S. Pat. Nos. 3,910,671, 3,926,498, 3,950,065 and 3,955,873.

In spite of this success, a number of disadvantages are associated with the prior art devices, resulting in their performance being not wholly satisfactory. For example, conventional prior art devices employ a thin, insulation-piercing jaw having a forked construction, with inside edges which penetrate the insulation and which also serve as contact surfaces to make the necessary electrical connection with the conductor. While these thin inside edges facilitate the insulation-piercing function of the contacts, they do not serve as optimal electrical contacts because of the small surface area actually engaging the conductor. Moreover, these edges have a tendency to cut or score the conductor thereby weakening the conductor and sometimes adversely affecting the desired current flow. Finally, the prior art contacts in some instances act to displace the insulation along the conductor, resulting in a compression of the insulation adjacent the insulation-piercing jaw. Compression of the insulation in this manner is not desirable, since it increases the force necessary for proper connection of the contact to the conductor and may impair the electrical connection as well.

SUMMARY OF THE INVENTION

It is a principal object of the present invention to provide a novel contact member which permits direct insulation-piercing connection to an electrical conductor without engendering the disadvantages associated with previously known devices of this general kind.

Another object of the invention is to provide a novel insulation-piercing terminal element, formed as a part of a unitary sheet metal contact member, that does not cut into or score the conductor to an appreciable extent when a connection is made.

Still another object of the invention is to provide a novel insulation-piercing terminal element, formed as a part of a unitary sheet metal contact member, that engages a substantial length of the conductor to assure an optimal electrical connection therebetween.

A further object of the invention is to provide a novel insulation-piercing terminal element, formed as a part of a unitary sheet metal contact, that does not displace the insulation on the conductor, but rather strips the insulation generally radially from the conductor.

Still a further object of the invention is to provide an insulation-piercing element, formed as a part of a unitary sheet metal contact member, that is configured to enhance the structural strength and rigidity of the contact, thereby enabling the utilization of thinner gauge sheet metal stock in its construction.

A specific object of the invention is to provide a novel unitary sheet metal contact member for multi-contact electrical connectors and miniaturized circuit boards that is simple and inexpensive to manufacture, yet provides an optimal mechanical and electrical connection with an insulation-covered conductor.

Accordingly, the present invention is generally directed to a contact member for use in forming a solderless connection with insulation-covered conductors wherein a novel insulation-piercing terminal element is employed with an active contact element. The insulation-piercing terminal includes insulation-cutting means to initially penetrate the insulation, insulation-stripping means to subsequently expose a longitudinal portion of the conductor and conductor-engaging means for establishing wiping engagement between the conductor and the contact member.

In accordance with a preferred embodiment of the invention the insulation-piercing terminal is formed as a part of a unitary contact member and includes two spaced and generally prallel side walls each having an insulation-cutting flange ingegral with a lateral edge thereof and an inclined insulation-stripping edge disposed longitudinally thereon. In addition, the inside surface of each side wall contacts a substantial longitudinal portion of the exposed conductor in wiping engagement therewith.

BRIEF DESCRIPTION OF THE DRAWINGS

The novel features which are believed to be characteristic of the invention are set forth in the appended claims. The invention itself, however, together with further objects and attendant advantages thereof, will be best understood by reference to the following description taken in connection with the accompanying drawings in which:

DETAILED DESCRIPTION OF THE PREFERRED EMBODIMENTS

Referring to FIGS. 1 through 6, a variety of different contact members are illustrated each employing the basic structural features of the preferred embodiment of the present invention. Each depicted contact member is preferably formed as a unitary structure from sheet metal stock and includes an active contact element 20 and a terminal element 22.

Figure 1:
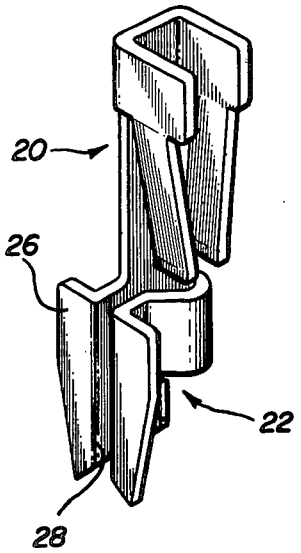
FIGS. 1 and 2 are opposite perspective views illustrating the present invention as employed in a socket contact.
Figure 2:
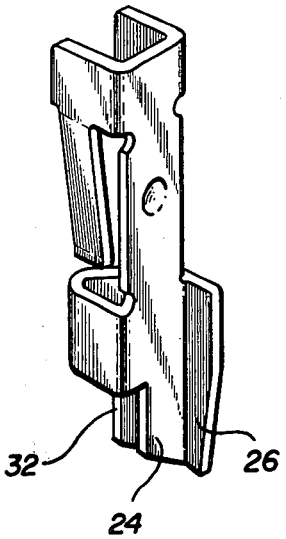
Figure 3:
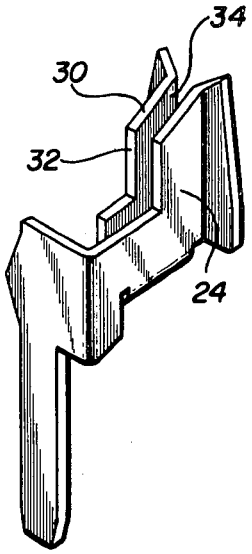
FIGS. 3 and 4 are also opposite perspective views illustrating the present invention as employed in a dip socket contact.
Figure 4:
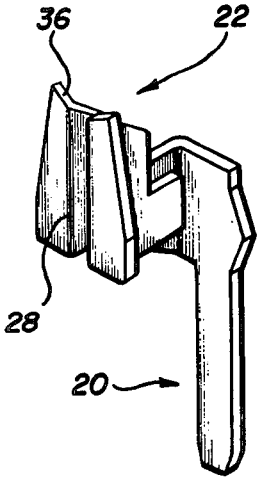
Figure 5:
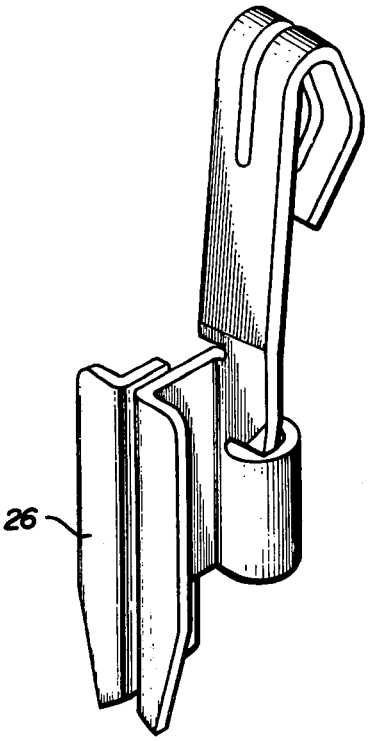
FIGS. 5 and 6 are again opposite perspective views illustrating the present invention as employed in a card edge contact.
Figure 6:
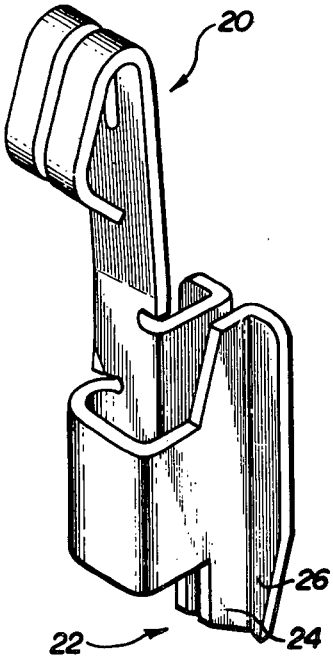

The active contact element 20 may be formed into any of a number of different structures adapted to connect to further conductors, circuit boards or other electrical components. For example, the active contact element 20 shown in FIGS. 1 and 2 is formed as a socket receptacle adapted to receive a pin or plug connector.

The terminal element 22 includes insulation-cutting means, insulation-stripping means and conductor-engaging means. More specifically, the terminal element 22 includes two spaced and generally parallel side walls 24, each having an insulation-cutting flange 26 formed integral with a first lateral edge 28, an insulation-stripping edge 30 extending from the first lateral edge 28 toward a second lateral edge 32, and an inside surface 34 which serves to contact the conductor in wiping engagement.

The side walls 24 are spaced such that the conductor, stripped of insulation, may be pressed therebetween. Since the side walls 24 have a certain degree of resiliency, they exert a full normal force in sliding friction contact with the conductor.

Figure 7:
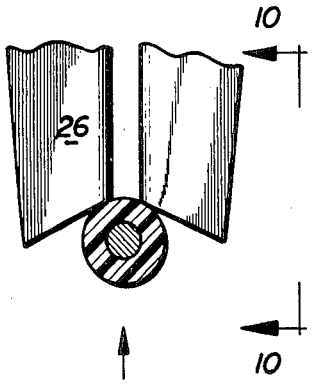
FIGS. 7 through 9 are elevational views taken along the longitudinal axis of the conductor, each illustrating a step in the sequence of operations used to connect the contact of the present invention to an insulated conductor.

Each insulation-cutting flange 26 extends outwardly from edge 28 of its respective side wall 24 and is preferably disposed generally perpendicular thereto. At the conductor-receiving end of the terminal 22 each flange 26 includes an insulation-cutting edge 36 which serves to radially penetrate the insulation of the conductor. The cutting edges 36 may be inclined inwardly, as shown in FIG. 7, thereby centering the conductor as it is pressed into the contact member. It will be appreciated by those skilled in the art that the flanges 36 enhance the strength and rigidity of the terminal element 22. Since this element is generally the component of the contact member subjected to the greatest force applications during use, the depicted structural configurations allows sheet stock of lighter gauge to be used. For example, prior art devices are generally fabricated from sheet metal having a thickness of about 0.010 to 0.012 inch, whereas contact members fabricated in accordance with the present invention may be manufactured from sheet metal having a thickness of about 0.006 to 0.010 inch. The use of lighter gauge sheet metal stock not only results in reductions in the cost of manufacture, but also provides greater freedom in the design of the terminal elements 22 and the various receptacles employed as the active contact elements 20.

Figure 8:
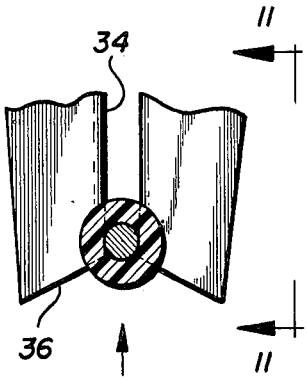
Figure 9:
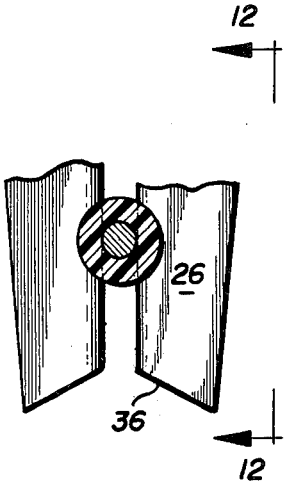
Figure 10:
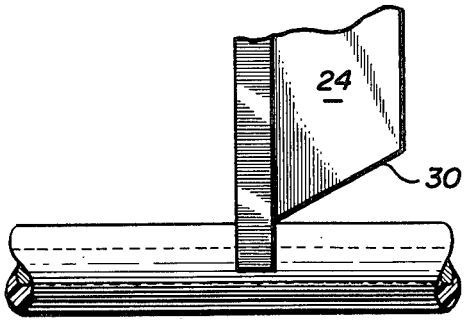
FIGS. 10 through 12 are side elevational views taken along lines 10—10, 11—11 and 12—12 in FIGS. 7 through 9, respectively.
Figure 11:
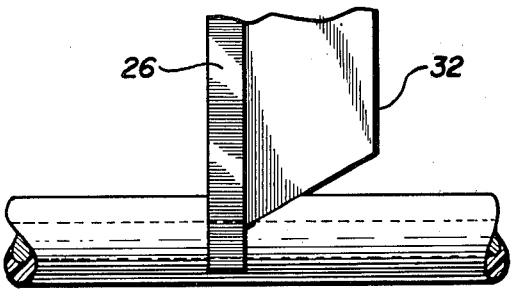
Figure 12:
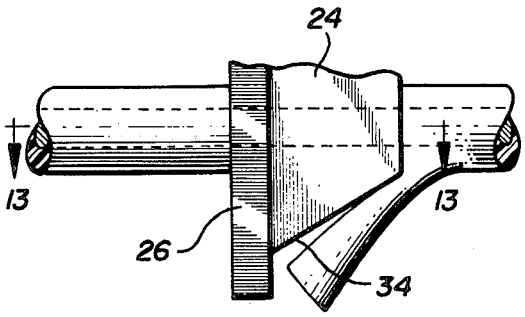

The insulation-stripping edges 30 are located at the conductor-receiving end of the terminal 22 and are preferably inclined in the cable-insertion direction (note the arrows in FIGS. 7 and 8) from the first lateral edge 28 toward the second lateral edge 32 of each side wall 24. The edges 30 will, therefore, incrementally strip the insulation from the conductor as it is pressed between the side walls 24, as illustrated in FIGS. 11 and 12. In this manner, a longitudinal portion 38 of the conductor is exposed for subsequent wiping engagement with the inside surfaces 34 of the side walls 24.

Figure 13:
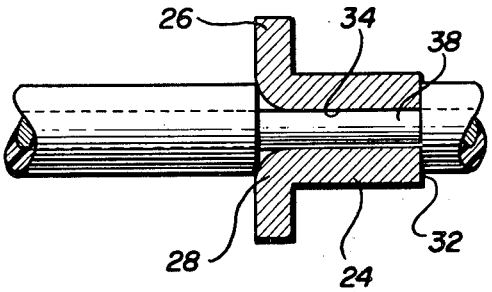
FIG. 13 is a cross-sectional view taken along line 13—13 of FIG. 12.

As can be clearly seen in FIG. 13, the terminal element 22 does not employ any cutting edge or surface which bears directly on the conductor. Thus, the scoring problems associated with prior art devices of this general type are substantially reduced or entirely eliminated.

In addition, the longitudinal dimension of the side walls 24 is substantially greater than the width of the flange 26. For example, the side wall 24 may have a dimension between edges 28 and 32 on the order of four times that of the width of flange 26. Accordingly, the contact member of the present invention provides a substantially increased surface area at the point of contact between the terminal 22 and the conductor, thereby enhancing the electrical connection obtained.

Finally, it will be apparent from the foregoing that the instant invention obviates the problems associated with insulation compression encountered with the use of some prior art contact members. In effecting connection of the contact member disclosed herein with a conductor, the insulation is not merely axially displaced on the conductor, but rather is radially removed or stripped incrementally from the conductor. Thus, no compression of the insulation occurs.

As disclosed hereinabove, the side walls 24 are "generally parallel" to one another, while each insulation-cutting flange 26 preferably extends "generally perpendicular" to its respective side wall. These terms are not intended to define specific geometric relationships, but rather are used to describe the general configuration of these components. Deviation from these described configurations, while not desirable, may be tolerated and, in some instances, may be unavoidable in fabricating these miniaturized contact members with commercial automated equipment.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. A contact member for connection with an insulation-covered conductor comprising:

an active contact element; and a terminal element adapted to pierce said insulation and electrically engage said conductor, said terminal element including insulation-cutting means for radially penetrating said insulation at a first longitudinal portion of said conductor, insulation-stripping means for stripping a segment of said insulation from a second longitudinal portion of said conductor and conductor-engaging means for contacting in wiping engagement substantially the entire length of said first and second longitudinal portions of said conductor, the portions of said terminal element contiguous with said conductor comprising smooth and continuous surfaces to prevent scoring of the conductor.

2. The contact member of claim 1 wherein said active contact element and said terminal element form a unitary sheet metal contact member.

3. The contact member of claim 1 wherein said second portion has a longitudinal dimension substantially greater than that of said first portion.

4. The contact member of claim 1 wherein said terminal element includes two spaced and generally parallel side walls and said insulation-cutting means comprises a pair of flanges each formed integral with a lateral edge of one said side wall and extending outwardly therefrom.

5. The contact member of claim 4 wherein each said insulation-cutting flange is disposed generally perpendicular to its respective side wall.

6. The contact member of claim 4 wherein said insulation-stripping means comprises an inclined edge on each said side wall.

7. The contact member of claim 6 wherein said conductor-engaging means comprises the inside surface of each said side wall.

8. The contact member of claim 7 wherein each said flange includes an inclined cutting edge whereby said conductor is centered between said side walls as said conductor is pressed into said terminal element.

9. A contact member for connection with an insulation-covered conductor comprising an active contact element and an insulation-piercing terminal element, said terminal element having two spaced and generally parallel side walls, each said wall including:

first and second lateral edges;

an outwardly extending insulation-cutting flange integral with said first edge and having a cutting edge disposed perpendicular to the axis of the conductor to radially penetrate the insulation on the conductor;

an insulation-stripping edge inclined in a conductor-insertion direction from said first edge toward said second edge; and an inside continuous surface free of cutting edges for engaging substantially the entire length of the conductor exposed after the insulation has been stripped therefrom.

10. The contact member of claim 9 wherein said insulation-cutting flanges are disposed generally perpendicular to their respective side walls.

11. The contact member of claim 9 wherein said insulation-stripping edges have a longitudinal dimension substantially greater than the width of said insulation-cutting flanges.

12. The contact member of claim 9 wherein said active contact element and said insulation-piercing terminal element form a unitary sheet metal contact member.

13. The contact member of claim 9 wherein each said insulation-cutting flange includes an insulation-cutting edge, each insulation-cutting edge being inclined to assist in centering said conductor as it engages said terminal element.

14. In a contact member for connection with an insulation-covered conductor, a terminal element comprising:

a pair of spaced side walls each including means for radially penetrating the insulation on a first longitudinal portion of said conductor, means for incrementally stripping a segment of said insulation from a second longitudinal portion of said conductor and means for contacting said first and second portions of said conductor in wiping engagement, the portions of said terminal element continguous with said conductor comprising smooth and continuous surfaces to prevent scoring of the conductor.

15. A unitary sheet metal contact member for interconnection with an insulation-covered conductor comprising an active contact element and an insulation-piercing terminal element, said terminal element having two spaced and generally parallel and substantially planar side walls, each said wall including:

an outwardly extending insulation-cutting flange integral with a first lateral edge of said side wall to radially penetrate the insulation covering a first longitudinal portion of the conductor;

an insulation-stripping edge inclined in a conductor-insertion direction away from said first edge and toward a second lateral edge to incrementally strip the insulation covering a second longitudinal portion of the conductor, said second portion having a substantially greater length than said first portion of the conductor; and an inside continuous surface free of cutting edges to engage both said first and second portions of the conductor after the insulation has been removed therefrom.

* * * * *